US008747165B2

(12) United States Patent
Kim

(10) Patent No.: US 8,747,165 B2
(45) Date of Patent: Jun. 10, 2014

(54) CONNECTION MODULE FOR PORTABLE DEVICE

(75) Inventor: Jung-Hoon Kim, Seoul (KR)

(73) Assignee: Tyco Electronics Amp Korea Ltd., Kyungsangbuk-do (KR)

( * ) Notice: Subject to any disclaimer, the term of this patent is extended or adjusted under 35 U.S.C. 154(b) by 0 days.

(21) Appl. No.: 13/414,160

(22) Filed: Mar. 7, 2012

(65) Prior Publication Data

US 2012/0231671 A1 Sep. 13, 2012

(30) Foreign Application Priority Data

Mar. 7, 2011 (KR) ..... 10-2011-0020016

(51) Int. Cl.
*H01R 24/68* (2011.01)

(52) U.S. Cl.
USPC ..... 439/660; 439/607.53

(58) Field of Classification Search
USPC ..... 439/660, 607.53
See application file for complete search history.

(56) References Cited

U.S. PATENT DOCUMENTS

| | | | | |
|---|---|---|---|---|
| 6,926,542 | B2 * | 8/2005 | Li | 439/79 |
| 7,632,111 | B2 * | 12/2009 | Xiong et al. | 439/79 |
| 7,704,101 | B2 * | 4/2010 | Nagata et al. | 439/660 |
| 7,713,093 | B2 * | 5/2010 | Kim | 439/660 |
| 7,824,220 | B2 * | 11/2010 | Chen | 439/607.35 |
| 7,942,704 | B2 * | 5/2011 | Ko et al. | 439/660 |
| 8,187,039 | B2 * | 5/2012 | Tsai | 439/660 |
| 2008/0299831 | A1 * | 12/2008 | Kim | 439/638 |
| 2009/0017693 | A1 * | 1/2009 | Nagata et al. | 439/660 |
| 2009/0130873 | A1 * | 5/2009 | He | 439/108 |
| 2012/0225583 | A1 * | 9/2012 | Kamarauskas et al. | 439/607.01 |
| 2012/0231643 | A1 * | 9/2012 | Kim | 439/170 |
| 2012/0231671 | A1 * | 9/2012 | Kim | 439/660 |

* cited by examiner

*Primary Examiner* — James Harvey
(74) *Attorney, Agent, or Firm* — Barley Snyder

(57) ABSTRACT

A connection module for a portable device having a reduced thickness and a slimmer shape. The connection module includes a case, an upper plug connection terminal unit, and a lower plug connection terminal unit. The case includes an upper portion and a lower portion. The upper plug connection terminal unit includes a plurality of upper connection terminals disposed along the upper portion. The lower plug connection terminal unit includes a plurality of lower connection terminals disposed along the lower portion. The plurality of lower connection terminals are spaced apart from the plurality of upper connection terminals and alternately arranged at staggered positions such that the plurality of upper and lower connection terminals engage each other when positioned on a same plane.

14 Claims, 7 Drawing Sheets

CONNECTION MODULE FOR PORTABLE DEVICE

CROSS-REFERENCE TO RELATED APPLICATION

This application claims the benefit of the filing dates under 35 U.S.C. §119(a)-(d) of KR Patent Application No. 10-2011-0020017, filed on Mar. 7, 2011.

FIELD OF THE INVENTION

The invention relates to a connection plug for a portable device, and more particularly to a connection plug having at least two kinds of plug connection terminal units installed with a single connection plug.

BACKGROUND

In general, commonly used portable devices have various functions including, for example, a video call function, information input/output function, data storage function as well as a simple voice call function.

With recent diversification in the functionality of portable devices, in particular, portable devices (hereinafter, also referred to as portable communication devices) have been provided with a variety of applications. In addition to a call function, specifically, recent portable devices may function as a storage medium containing personal information or other credit purchase information and also, may exhibit even somewhat complex functions, such as a picture or moving image capturing function, a music or moving image file reproduction function, a game playing function, a broadcast receiving function, and the like. In addition, multimedia devices that combine the aforementioned functions have been developed.

Portable devices are provided with various shapes of connection modules, which correspond to various connectable devices required to implement the above described various additional functions. Examples of these connectable devices and connection modules may include USB (Universal Serial Bus) ports for data reception/transmission and other input/output ports for connection of input/output units for signal interface, such as earphones, remote controllers and televisions.

With reference to FIGS. 5 and 6, a known connection module 1, as disclosed in Korean Patent Application No. 2007-0054532 (entitled "Connection Module for Mobile Communication Device"), is shown. In the known connection module 1, connection terminals of a USB (Universal Serial Bus) connection terminal unit 42 and of an input/output connection terminal unit 46 are configured to have different lengths and are installed at different heights within a case 20.

More particularly, of the shown connection modules, the USB connection terminal unit 42 is used to be connected to connection terminals of a USB plug, and the input/output connection terminal unit 46 is located beneath the USB connection terminal unit 42 so as to be stepped with the USB connection terminal unit 42 and is used to be connected to connection terminals of an input/output plug.

The USB connection terminal unit 42 includes a plurality of USB connection terminals 44, which are contained within an upper region of the case 20 so as to penetrate from a front end to a rear end of the case 20, a lower surface of a tip end of each USB connection terminal 44 being exposed so as to be connected to a corresponding connection terminal of the USB plug.

The input/output connection terminal unit 46 includes a plurality of input/output connection terminals 48, each of which is inserted into an receiving passageway 45 formed in a lower portion of the case 20. The input/output connection terminals 48 are shorter than the USB connection terminals 44 and are located more rearward than the USB connection terminals 44 so as to keep tip ends of the USB connection terminals 44 exposed. The input/output connection terminals 48 can be connected to corresponding connection terminals of the input/output plug.

However, in the known connection terminal units, the USB connection terminal unit 42 and the input/output connection terminal unit 46 are located on a straight line, which disadvantageously increases a thickness of the entire connection module in proportion to the total thickness of the USB connection terminal unit 42 and the input/output connection terminal unit 46.

More specifically, the above described known connection module 1 cannot meet a need for a slimmer connection module suitable for a slimmer mobile communication terminal.

Moreover, while the number of the USB connection terminals 44 of the USB connection terminal unit 42 is currently standardized to 5 pins, the input/output connection terminal unit 48 is variable in the number of pins according to manufacturers.

Referring to FIG. 6, when the USB plug is inserted into the connection module 1 and is connected to the USB connection terminals 44, the USB plug may be secured to the case 20 as locking bosses (not shown) of the USB plug are inserted into locking receiving passageways 22 perforated in both sides of an upper surface of the case 20.

However, if the number of the input/output connection terminals 48 of the input/output connection terminal unit 46 is increased, providing additional means for fixing the input/output plug is impossible. Therefore, when the input/output plug is connected to the input/output connection terminal unit 46, this connection cannot be fixedly kept.

Although an extra space for formation of eking receiving passageways for fixing of the input/output plug should be provided at both lateral sides of the input/output connection terminals 48 within the case 20, this increases the width of the entire connection module 1, making it impossible to use the connection module 1 in a slim mobile communication device.

In addition, in the above described known connection module 1, because the USB connection terminals 44 are located to penetrate from one side to the other side of the case 20, the USB connection terminals 44 can be integrally insert injection molded with the case 20 during injection molding of the case 20. On the other hand, in the case of the input/output connection terminals 46 each having one end located inside the case 20, an additional core member in the form of the receiving passageway 45 must be introduced for formation of the receiving passageway 45 during injection molding of the case 20 and after the case 20 has been injection molded, additional troublesome operations of removing the core member and inserting the input/output connection terminal 46 into the receiving passageway 45 must be performed.

In particular, the operation of removing the core member after insert injection molding of the case 20 is time consuming and troublesome and increases manufacturing costs.

SUMMARY OF THE INVENTION

Therefore, the invention has been made in view of the above problems, and it is one object of the invention, among others, to provide a connection module for a portable device, which can achieve a reduced thickness despite the fact that connection terminal units are respectively installed to upper and lower portions of a case thereof.

The connection module includes a case, an upper plug connection terminal unit, and a lower plug connection terminal unit. The case includes an upper portion and a lower portion. The upper plug connection terminal unit includes a plurality of upper connection terminals disposed along the upper portion. The lower plug connection terminal unit includes a plurality of lower connection terminals disposed along the lower portion. The plurality of lower connection terminals are spaced apart from the plurality of upper connection terminals and alternately arranged at staggered positions such that the plurality of upper and lower connection terminals engage each other when positioned on a same plane.

BRIEF DESCRIPTION OF THE DRAWINGS

The above and other objects, features and other advantages of the invention will be more clearly understood from the following detailed description taken in conjunction with the accompanying drawings, in which.

DETAILED DESCRIPTION OF THE EMBODIMENT(S)

Hereinafter, an exemplary embodiment of the invention will be described in more detail with reference to the accompanying drawings.

Figure 1:
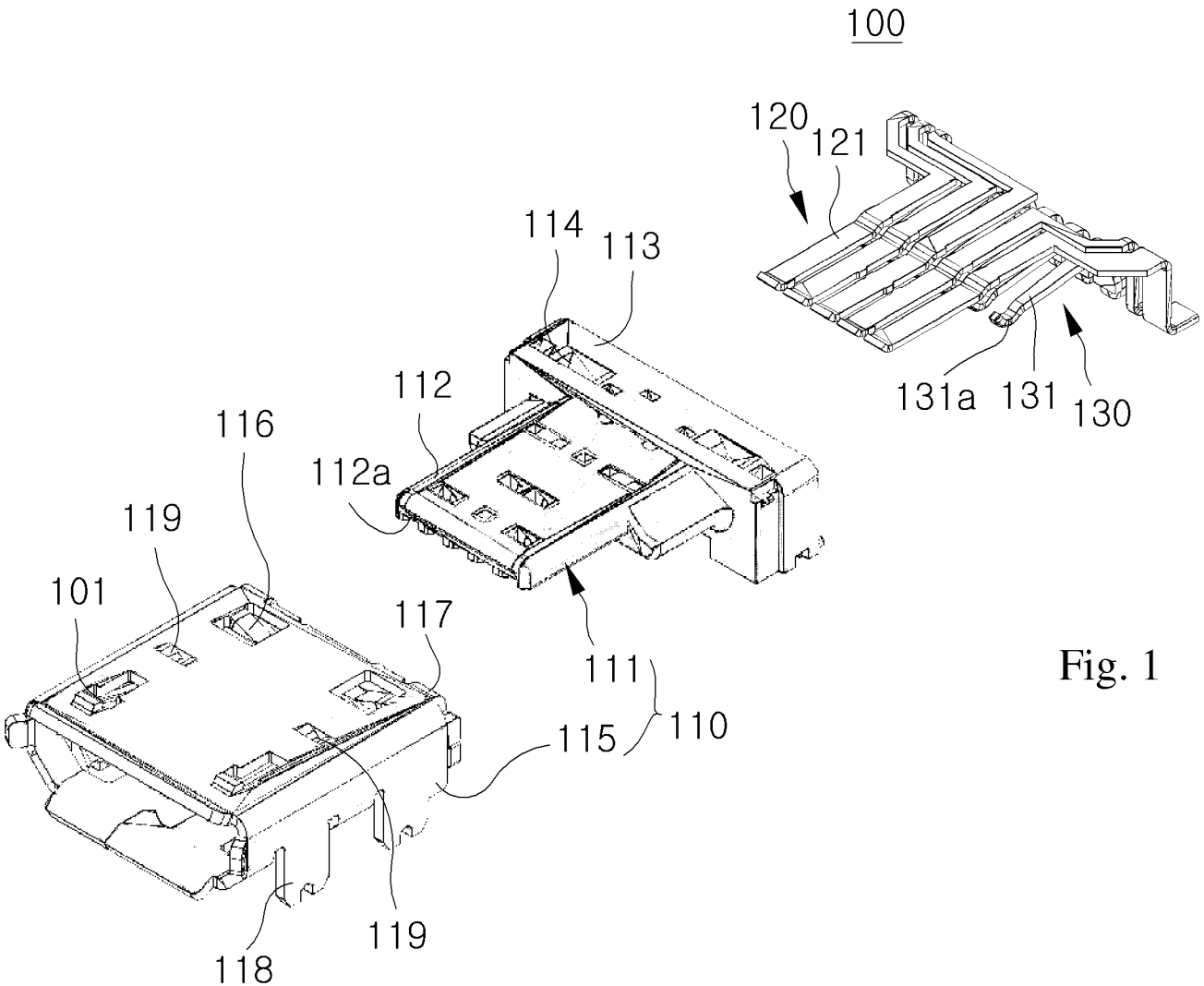
FIG. 1 is an exploded perspective view of a connection module according the invention.
Figure 2:
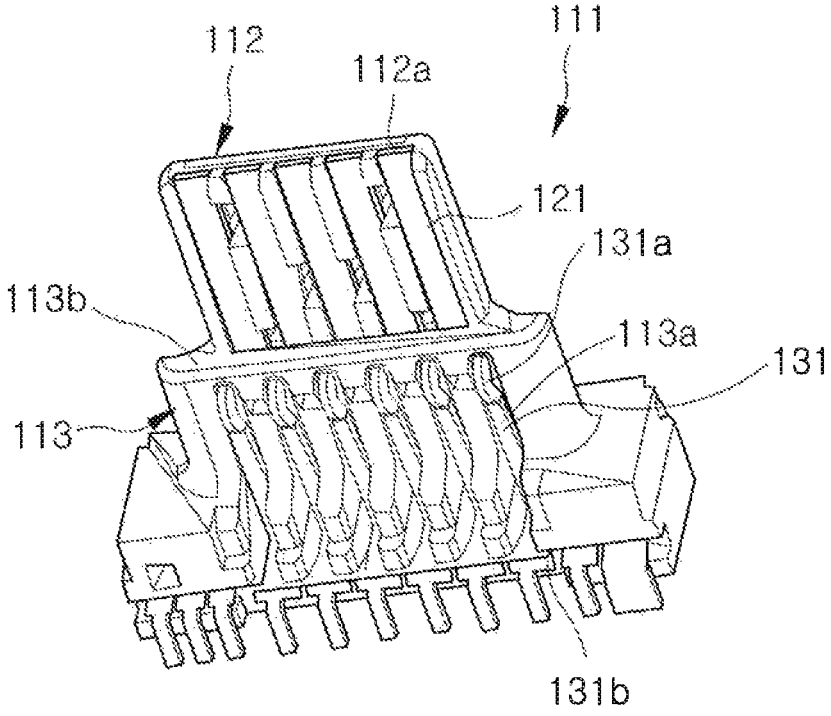
FIG. 2 is a partial perspective view of the connection module according the invention.
Figure 3:
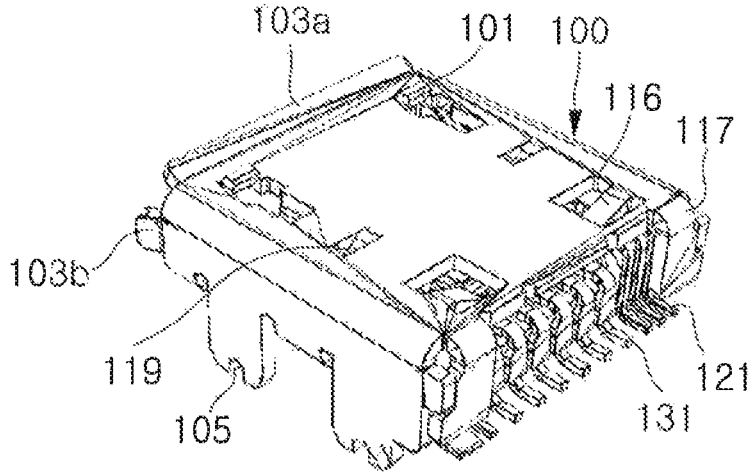
FIG. 3 is a partial perspective view of the connection module according the invention.

With reference to the FIGS. 1-3, the connection module 100 for a portable device is configured in such a manner that a single case 110 is provided with individual connection terminal units 120 and 130, which are used to be connected to different kinds of connection plugs. The connection terminal units include an upper connection terminal unit 120 and a lower connection terminal unit 130 accommodated within the case 110.

In the shown embodiment, the upper connection terminal unit 120 is a USB connection terminal unit for connection with a USB plug and has a standardized size consisting of five connection terminals. The lower connection terminal unit 130 is an input/output connection terminal unit for connection with an input/output plug and consists of six connection terminals. Of course, it will be appreciated that connection plugs to be connected to the upper connection terminal unit 120 and the lower connection terminal unit 130 may be changed according to use purposes.

The upper connection terminal unit 120 includes five upper connection terminals 121 and the lower connection terminal unit 130 includes six lower connection terminals 131, the upper connection terminals 121 and the lower connection terminals 131 being alternately arranged at staggered positions.

Referring to FIG. 2, the case 110 includes an installation case 111, to which the upper connection terminal unit 120 and the lower connection terminal unit 130 are respectively installed, and an outer case 115 configured to surround the installation case 111.

The installation case 111 includes an upper mount 112, to which the upper connection terminal unit 120 is installed, and a lower mount 113 to which the lower connection terminal unit 130 is installed, the upper mount 112 and the lower mount 113 being integrally formed with each other. Here, the upper mount 112 is longer than the lower mount 113 and thus, the upper mount 112 and the lower mount 113 define a stepped portion 113*b*.

More particularly, the installation case 111 is insert injection molded where the upper connection terminals 121 are located at the upper mount 112. Accordingly, in consideration of the fact that the upper connection terminals 121 are configured to extend from a front end to a rear end of the case 110, the upper mount 112 of the installation case 111 has a length corresponding to that of the upper connection terminals 121. The upper mount 112 is configured to expose lower surfaces of the upper connection terminals 121 that connect to a connection plug 200 (see FIGS. 4A and 4B).

As a result, the upper mount 112, which serves as a USB port, is provided along a lower surface thereof with five upper terminal exposure grooves 112*a* corresponding to the respective upper connection terminals 121 such that the upper connection terminals 121 are respectively inserted into the upper terminal exposure grooves 112*a*.

The upper mount 112 and the lower mount 113 of the installation case 111 are injection molded together such that the lower connection terminals 131 are installed below the upper mount 112. The lower mount 113 is provided along a lower surface thereof with six lower installation grooves 113*a* which allow the lower connection terminals 131 to be located below the upper connection terminals 121.

Accordingly, a length of the lower mount 113 is less than a length of the upper mount 112 and a length of the lower installation grooves 113*a* corresponds to a length of the lower connection terminals 131. The lower connection terminals 131 are inserted respectively into the lower installation grooves 113*a* such that lower surfaces of the lower connection terminals 131 are exposed.

Preferably, the upper exposure grooves 112*a* and the lower installation grooves 113*a* are alternately arranged at staggered positions, so as to allow the upper connection terminals 121 and the lower connection terminals 131 to be alternately arranged with each other, rather than facing each other.

The lower installation grooves 113*a* are configured to provide a secure fit with the lower connection terminals 131. In the embodiment shown, a rear end of each lower installation groove 113*a* has a shape corresponding to a cross-shaped end 131*b* of the lower connection terminal 131, which can prevent the interference fitted lower connection terminal 131 from being unintentionally separated from the lower installation groove 113*a*. Accordingly, it will be appreciated that the shape of the rear end of the lower installation groove 113*a* is not limited to the cross shape in the shown embodiment, but may have other shapes.

The installation case 111 is provided along an upper surface thereof with an outer case receiving passageway 114 for coupling with the outer case 115 that will be described hereinafter.

As such, the upper connection terminals 121 can be located at the upper mount 112 during injection molding of the installation case 111 without an additional assembly process, the lower connection terminals 131 can be simply assembled into the lower installation grooves 113*a* using a secure fit, and the installation case 111 can be coupled with the outer case 115.

Referring to FIG. 3, the outer case 115 takes the form of a box having a front open side and serves to protect the respective connection terminals as the installation case 111 is inserted into the outer case 115. The outer case 115 is provided along an upper surface thereof with a coupler 116 for coupling with the installation case 111. Here, the coupler 116 obliquely protrudes downward from the upper surface of the outer case 115.

Preferably, the outer case 115 is further provided along the upper surface thereof with a plug coupling receiving passageway 101, which can maintain the connection plug 200 inserted into the connection module 100.

Once the connection plug 200 has been inserted into the connection module 100, plug connection terminals of the connection plug 200 are connected to connection terminals of the connection module 100, allowing the connection plug 200 to perform a plug function, such as for example, battery charge of a portable device or reception/transmission of a variety of information between a portable device and an electronic appliance. If the connection plug 200 is unintentionally separated from the connection module 100 and the respective connection terminals thereof are disconnected during a certain operation, this causes sudden stoppage of the operation, resulting in, e.g., information loss or electric short of the connection terminals. Providing the outer case 115 with the plug coupling receiving passageway 101 can eliminate this problem.

An insertion guide member 119 protrudes downward from the upper surface of the outer case 115 and serves to guide an insertion position of the connection plug 200 with respect to the connection module 100. More particularly, if the connection plug 200 is excessively or insufficiently inserted into the connection module 100, efficient connection between the respective connection terminals is not possible.

To eliminate this problem, the insertion guide member 119 serves as a stopper to prevent excessive insertion of the connection plug 200 by coming into contact with a front surface of the connection plug 200, thereby allowing the connection plug 200 to be inserted only to a position where the connection terminals of the connection module 100 can be stably connected to the plug connection terminals of the connection plug 200. In addition, when the user inserts the connection plug 200, the insertion guide member 119 assists the user in determining that the connection plug 200 is sufficiently inserted as the insertion guide member 119 comes into contact with the connection plug 200.

The outer case 115 is further provided with a support 117, which first extends horizontally from a rear end of the upper surface of the outer case 115 and then, is bent downward to extend along a rear surface of the outer case 115. The support 117 defines a part of the rear surface of the outer case 115 and supports a rear surface of the installation case 111 inserted into the outer case 115.

In addition, the outer case 115 is provided with a plurality of guides 103*a* and 103*b* to guide the connection plug 200. The guides 103*a* and 103*b* are arranged along upper and lower edges and both lateral edges of one side of the outer case 115, from which the connection plug 200 is introduced into the outer case and are shaped to be tapered inward. A fixing member 105 is formed in a lower end of the outer case 115, so as to allow the outer case 115 to be secured to a circuit board (not shown).

In the shown embodiment, the upper and lower connection terminal units 120 and 130 are arranged in such a manner that the five upper connection terminals 121 of the upper connection terminal unit 120 are equidistantly arranged and the lower connection terminals 131 are located between the respective neighboring upper connection terminals 121.

Preferably, a width of the lower connection terminals 131 is equal to or less than a distance between the upper connection terminals 121, in order to prevent the upper connection terminals 121 and the lower connection terminals 131 from overlapping.

Accordingly, when the upper connection terminal unit 120 and the lower connection terminal unit 130 are alternately arranged at staggered positions, even if the connection plug 200 is inserted and connected to the lower connection terminals 131 to thereby pressurize the lower connection terminals 131 upward, the lower connection terminals 131 can be moved upward between the upper connection terminals 121, which can eliminate a need for individual spaces for connection of the upper connection terminals and the lower connection terminals. In this way, the height of the connection module 100 can be reduced and consequently, the size of the connection module 100 can be reduced.

In other words, different from the previously described known configuration, in which the upper and lower connection terminal units are arranged on a straight line to face each other and thus, need a sufficient distance therebetween so as not to interfere with each other, in the present embodiment, the upper connection terminal unit 120 and the lower connection terminal unit 130 are alternately arranged at staggered positions without a risk of interference therebetween, which can reduce an installation space of both the connection terminals units 2 and 130, resulting in a reduction in the size of the connection module 100.

In the shown embodiment, the upper connection terminals 121 are longer than the lower connection terminals 131 and a surface of each upper connection terminal 121 to be connected to the connection plug 200 is configured to be bulged downward, which can ensure easy connection between the upper connection terminal 121 and the connection plug 200.

In the shown embodiment, the lower connection terminals 131, which are shorter than the upper connection terminals 121, are preferably configured in such a manner that an end of each lower connection terminal 131 is defined by a downwardly bulged curved surface 131*a*, in the embodiment shown, to ensure easy connection with the connection plug 200.

The lower connection terminals 131 have rear ends protruding rearward from the case 110, and the upper connection terminals 121 have rear ends gradually spreading rearward of the case 110 so as to be located outward of opposite sides of the lower ends of the lower connection terminals 131. The rear ends of the upper connection terminals 121 and the lower connection terminals 131 are connected to a circuit board (not shown) so as to be connected to the respective plug connection terminals.

When the connection plug 200 connected to the connection module 100 is simultaneously connected to both the upper and lower connection terminal units 120 and 130, or is selectively connected to the upper connection terminal unit 120 or the lower connection terminal unit 130, the circuit board is used, according to the terminal unit(s) connected thereto, for the purpose of battery charge or information reception/transmission. Preferably, the circuit board is installed so as not to protrude toward the open side of the outer case 115.

As such, once the upper and lower connection terminals 131 and 121 have been located at a rear end of the connection module 100, the upper and lower connection terminals 131 and 121 can be stably connected to the circuit board, which enables stable implementation of a desired function.

Hereinafter, a use mode of the connection module for a portable device according to the invention will be described in detail, with reference to the Figures.

Figure 4A:
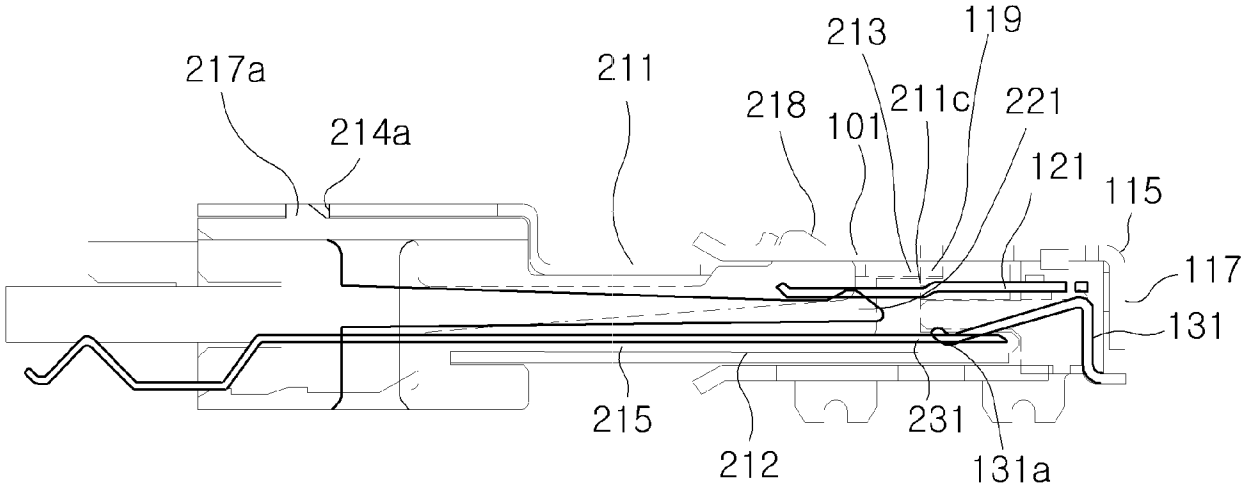
FIG. 4A is a sectional view of a connection plug inserted into the connection module according the invention.
Figure 4B:
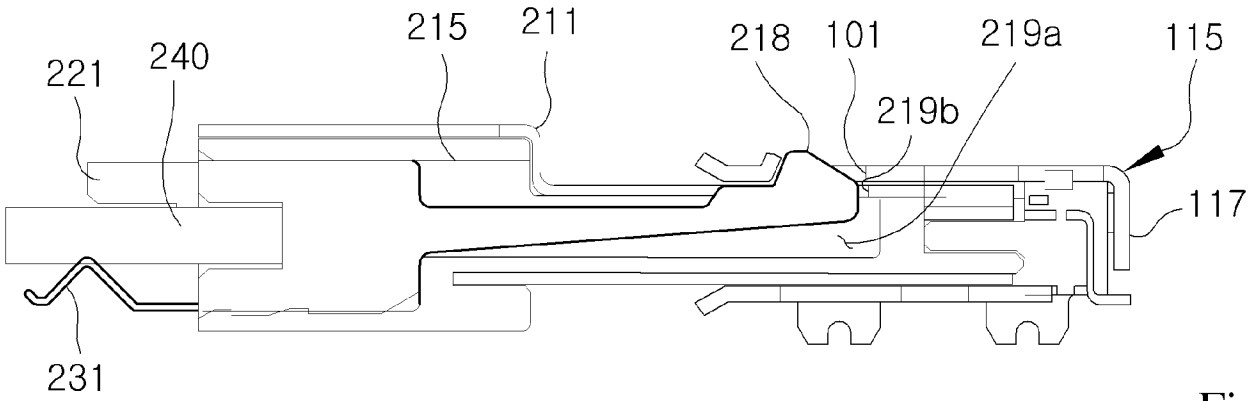
FIG. 4B is another sectional view of the connection plug inserted into the connection module according the invention.
Figure 5:
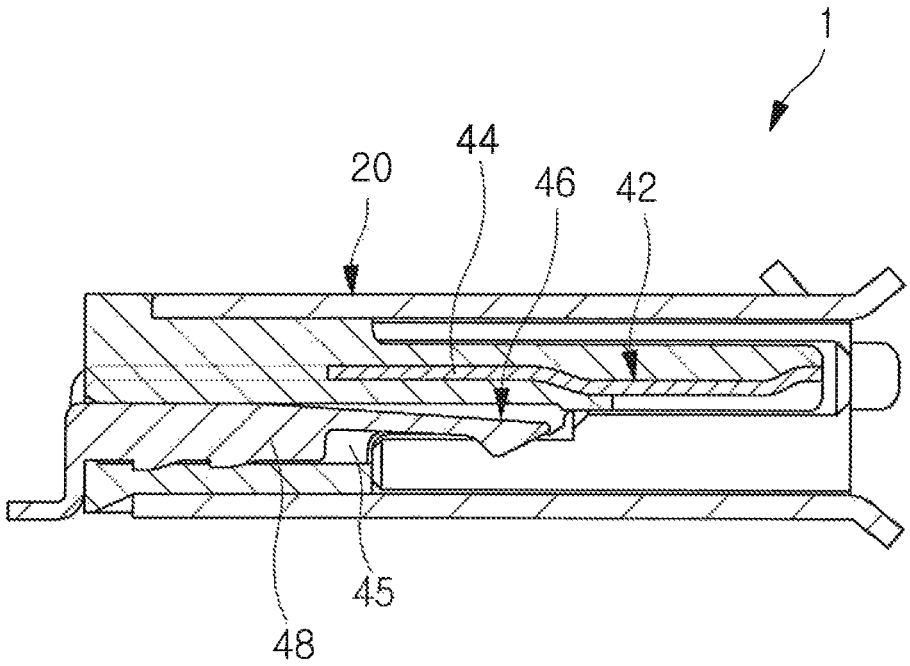
Fig.5 PRIOR ART
FIG. 5 is a side sectional view of a known connection module.
Figure 6:
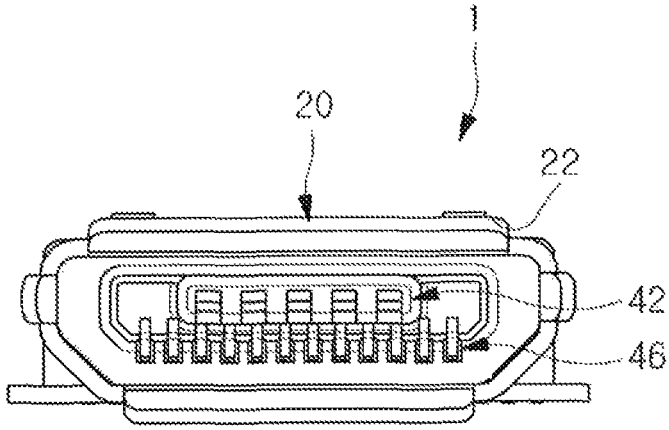
Fig.6 PRIOR ART
FIG. 6 is a front view of the known connection module.

As shown in FIGS. 4A and 4B, if the connection plug 200 is inserted into the connection module 100 embedded in an electronic appliance, such as a portable device, the connection plug 200 and the connection module 100 are connected to each other, to allow the electronic appliance to be connected to another appliance using the connection plug 200 for the purpose of battery charge or information reception/transmission.

In order to maintain and complete connection between the connection plug 200 and the upper connection terminals 121, upper plug connection terminals 221, upper surfaces of which are exposed so as to be connected to the lower surfaces of the upper connection terminals 121, are provided into the connection module 100. Accordingly, the upper plug connection terminals 221, the upper surfaces of which are exposed, have a relatively short length so as to be connected to the upper connection terminals 121 having a relatively great length. Also, the upper plug connection terminals 221 are shaped to protrude downward, which ensures easy connection between the upper plug connection terminals 221 and the upper connection terminals 121.

The lower connection terminals 131 are located below the upper connection terminals 121 and have a length less than that of the upper connection terminals 121. Accordingly, to realize connection between the connection plug 200 and the lower connection terminals 131, lower plug connection terminals 231, upper surfaces of which are exposed so as to be connected to the lower surfaces of the lower connection terminals 131, are provided into the connection module 100. Accordingly, the lower plug connection terminals 231 have a length greater than that of the above described upper plug connection terminals 221 and thus, can be provided into the connection module 100 until they are connected to the lower connection terminals 131.

As described above, the end of each lower connection terminal 131 to come into contact with the lower plug connection terminal 231 is defined by the downwardly bulged curved surface 131*a*. Thus, the lower connection terminal 131 can act to pressurize the lower plug connection terminal 231 downward so as to ensure easy introduction of the lower plug connection terminal 231. In other words, it is possible to minimize friction caused when the lower plug connection terminal 231 comes into contact with the curved surface 131*a*, and to allow the lower plug connection terminal 231 to be connected to the lower connection terminal 131 simultaneously with introduction thereof.

Here, the upper connection terminals 121 and the lower connection terminals 131 are alternately arranged at staggered positions by a predetermined distance so as not to overlap when they are positioned on the same plane. Accordingly, even if the lower plug connection terminals 231 act to push the lower connection terminals 131 upward when the respective terminals are connected to each other and in particular, when the lower connection terminals 131 are connected to the lower plug connection terminals 231, it is possible to prevent the lower connection terminals 131 from coming into contact with the upper connection terminals 121.

In particular, as compared to the previously described known configuration in which the upper connection terminals and the lower connection terminals have a sufficient space therebetween to prevent interference, in the connection module 100 of the invention, the upper and lower connection terminals 121 and 131 are alternately arranged at staggered positions, which can enable a minimal space between the upper and lower connection terminals 121 and 131 without a risk of interference. As a result, the size of the connection module 100 can be reduced, resulting in a slimmer connection module.

Preferably, to correspond to the alternately arranged upper and lower connection terminals of the connection module 100, the upper and lower plug connection terminals 221 and 231 of the connection plug 200 are similarly alternately arranged at staggered positions. Thus, it will be appreciated that the upper and lower connection terminals 121 and 131 can simultaneously be connected to the upper and lower plug connection terminals 221 and 231.

In the shown embodiment, as the connection plug 200 is inserted, into the connection module 100, an insert piece 218 provided at the connection plug 200 is inserted into the plug coupling receiving passageway 101 of the connection module 100.

The plug coupling receiving passageway 101 serves not only to guide an insertion position of the connection plug 200 with respect to the connection module 100 so as to prevent the connection plug 200 from being excessively deeply inserted into the connection module 100, but also to prevent the connection plug 200 from being unintentionally separated from the connection module 100 during battery charge or information reception/transmission.

The connection plug 200 is installed to come into contact with the insertion guide member 119 of the outer case 115, which enables guidance of the connection plug 200 into an installation position.

In the connection module 100 according to the invention, the upper and lower connection terminals 121 and 131 are alternately arranged at staggered positions and the number of the upper connection terminals 121 and the number of the lower connection terminals 131 are equal to each other or have a difference of only one or two. Accordingly, a connection plug for connection with the upper connection terminals and a connection plug for connection with the lower connection terminals can be secured by means of the plug coupling receiving passageway 101.

In conclusion, with the above described connection module 100, different kinds of connection terminals are alternately arranged at staggered positions within a single case, which can prevent interference between the respective connection terminals even in a narrow space upon connection of a plug, resulting in a slimmer connection module.

As is apparent from the above description, according to the invention, upper connection terminals and lower connection terminals installed respectively to upper and lower portions of a case of a connection module are alternately arranged at staggered positions so as not to face each other, thereby being engaged with each other when located on the same plane. This eliminates interference between different kinds of connection terminals when the connection terminals of the connection module are connected to plug connection terminals of a plug without requiring individual spaces for connection of the different kinds of connection terminals. As a result, a thickness of the connection module can be reduced, resulting in a slimmer connection module.

Further, according to the invention, the upper connection terminals are insert injection molded and lower installation grooves for the assembly of the lower connection terminals are formed during injection molding of an installation case, which can simplify a production process of the connection module, resulting in enhancement in productivity.

Furthermore, according to the invention, an outer case is additionally provided around the installation case and is secured to the installation case, which can provide protection of the respective connection terminals.

According to the invention, the outer case is provided with a plug coupling receiving passageway for coupling of the plug when the plug is inserted into the outer case. This can prevent the plug from being unintentionally separated from the outer case during implementation of a particular operation in a state in which the connection module and the plug are connected to each other, which can prevent, e.g., loss of information due to sudden disconnection during operation.

According to the invention, the outer case is internally provided with an insertion guide member serving as a stopper to limit an insertion position of the plug. Thus, it is possible to prevent the plug from being excessively or insufficiently inserted into the outer case, thus preventing a failure in the connection of the respective connection terminals.

According to the invention, a distance between the upper connection terminals corresponds to a width of the lower connection terminals and the upper connection terminals and the lower connection terminals have different lengths, which can prevent interference between the upper and lower connection terminals and thus, ensure stable connection with the plug.

According to the invention, rear ends of the upper connection terminals and the lower connection terminals installed to upper and lower portions of the case are arranged at the same side and thus, can be easily connected to a circuit board independently or simultaneously. As such, it is possible to allow one or two plugs to be connected individually or simultaneously to a single connection module.

In addition, according to the invention, a front end of each lower connection terminal is defined by a downwardly bulged curved surface, which can ensure easy connection between the lower connection terminal and a corresponding plug connection terminal of the plug.

According to the invention, a rear end of each lower connection terminal has a cross shape and is installed by interference-fit. Accordingly, even if the lower connection terminal is simply assembled to the case, the lower connection terminal can be stably secured to the case, which can provide stable connection between the connection module and the plug.

Although the exemplary embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A connection module for a portable device, the connection module comprising:

a case having an upper portion and a lower portion:

an upper plug connection terminal unit having a plurality of upper connection terminals disposed along the upper portion;

a lower plug connection terminal unit having a plurality of lower connection terminals disposed along the lower portion, the plurality of lower connection terminals being spaced apart from the plurality of upper connection terminals and alternately arranged at staggered positions such that the plurality of upper and lower connection terminals engage each other when positioned on a same plane; and an outer case surrounding the case and upper and lower plug terminal units and having a stopper protruding downward from the upper surface of the outer case and corresponding to placement of the plurality of upper and lower connection terminals.

2. The connection module according to claim 1, wherein the case includes an installation case to which the upper plug connection terminal unit and the lower plug connection terminal unit are disposed.

3. The connection module according to claim 2, wherein the installation case includes an insert molded upper mount that exposes a lower surface of each of the plurality of upper connection terminals.

4. The connection module according to claim 3, wherein the installation case includes a lower mount having a lower insertion groove into which each of the plurality of lower connection terminals are assembled.

5. The connection module according to claim 4, wherein a length of the insert molded upper mount is greater than a length of the lower mount.

6. The connection module according to claim 2, wherein the case further includes the outer case surrounding the installation case.

7. The connection module according to claim 6, further comprising a plug coupling receiving passageway disposed on the outer case.

8. A connection module for a portable device, the connection module comprising:

a case having an upper portion with a plurality of upper terminal exposure grooves and a lower portion with a plurality of lower installation grooves such that the plurality of upper exposure grooves and the plurality of lower installation grooves are alternately staggered with respect to each other;

an upper plug connection terminal unit having a plurality of upper connection terminals disposed along a lower surface of the upper portion and inserted into the plurality of upper terminal exposure grooves; and a lower plug connection terminal unit having a plurality of lower connection terminals disposed along an upper surface of the lower portion and inserted into the plurality of lower terminal exposure grooves and having a length less than a length of the plurality of upper connection terminals, the plurality of lower connection terminals being spaced apart from the plurality of upper connection terminals and alternately arranged at staggered positions such that the plurality of upper and lower connection terminals engage each other when positioned on a same plane.

9. The connection module according to claim 1, wherein a distance between each of the plurality of upper connection terminals corresponds to a width of the plurality of lower connection terminals installed to the lower portion of the case.

10. The connection module according to claim 9, wherein the plurality of lower connection terminals disposed along the lower portion of the case have a length less than a length of the plurality of upper connection terminals disposed along the upper portion of the case.

11. The connection module according to claim 8, wherein the upper portion has a length corresponding to that of the upper connection terminals and is configured to expose lower surfaces of the plurality of upper connection terminals.

12. The connection module according to claim 10, wherein each of the plurality of lower connection terminals includes a front end having a downwardly bulged curved surface.

13. The connection module according to claim 10, wherein the plurality of lower connection terminals are securely fit in the case.

14. The connection module according to claim 1, further comprising a support extends horizontally from a rear end of the upper portion and being bent downward to extend along a rear surface of the outer case.

* * * * *